US005239948A

United States Patent [19]

Sajewski

[11] Patent Number: 5,239,948

[45] Date of Patent: Aug. 31, 1993

[54] HEAT EXCHANGE SYSTEM UTILIZING CAVITATING FLUID

[75] Inventor: Ronald Sajewski, Rochester, Mich.

[73] Assignee: Applied Hydro Dynamics, Inc., Rochester, Mich.

[21] Appl. No.: 14,115

[22] Filed: Feb. 5, 1993

Related U.S. Application Data

[62] Division of Ser. No. 698,545, May 10, 1991, Pat. No. 5,184,576.

[51] Int. Cl.[5] ..... F22B 3/06

[52] U.S. Cl. ..... 122/26; 126/247

[58] Field of Search ..... 122/26, 406.5; 126/247

[56] References Cited

U.S. PATENT DOCUMENTS 4,371,112 2/1983 Molen ..... 122/26 X 5,184,576 2/1993 Sajewski ..... 122/26

*Primary Examiner*—John C. Fox

*Attorney, Agent, or Firm*—Dykema Gossett

[57] ABSTRACT

A unique heat exchange system is disclosed in which pulses pressurized fluid are directed into a vessel. The pulsed fluid preferably cavitates within the vessel, generating heat in the fluid. That heat is then directed to a downstream heat exchange structure where it heats a second fluid medium. The pulses of fluid are cyclically controlled by a control valve to optimize the cavitation within the vessel.

8 Claims, 6 Drawing Sheets

HEAT EXCHANGE SYSTEM UTILIZING CAVITATING FLUID

This is a divisional of copending application Ser. No. 07/698,545 filed on May 10, 1991 now U.S. Pat. No. 5,184,576.

BACKGROUND OF THE INVENTION

The present invention relates to a method of generating heat utilizing cavitation of a pulsating pressurized fluid.

Various methods of heat exchange are known in the prior art. Typically, heat exchange systems heat a fluid in some way, and then pass a transfer medium over that heated fluid within a heat exchange structure to transfer heat to the transfer medium. Typically, heat may be passed to the heated fluid by boiling the fluid within a vessel of some sort.

Prior art heat exchange systems have deficiencies in that large amounts of energy are used to heat the fluid. Further, with known heat exchange systems, the vessel is typically exposed to the fluid, and deposits such as scale and other impurities may form on internal surfaces of the vessel.

It would be desirable to reduce the amount of energy required to heat a fluid to be used as a heated fluid for heat exchange. Further, it would be desirable to develop a heat exchange system wherein the vessel in which the fluid is heated is self-cleaning.

SUMMARY OF THE INVENTION

In a disclosed embodiment of the present invention a fluid is pulsed into a vessel, and the pulsed fluid transfers pressure into heat within the vessel. The fluid is heated and directed downstream, where the heat is used.

In a preferred embodiment of the present invention the heated fluid is passed through a heat exchanger and a second fluid is passed over the heat exchange. Preferably, a fan directs air over the heat exchanger such that the air is heated by the fluid.

In a preferred embodiment of the present invention the pressure and timing of the fluid pulses are selected such that the fluid cavitates within the vessel. This cavitation generates the heat in the fluid, and also cleans the internal surfaces of the vessel. Thus, the heat exchange vessel of the present invention is self-cleaning, and requires less maintenance than prior art heat exchange systems.

Cavitation is an occurrence which is preferably avoided in most fluid operations. Cavitation is the formation of bubbles within a fluid when that fluid reaches its vapor pressure. The vapor pressure is dependent on the fluid temperature, and when a fluid reaches a particular vapor pressure for a particular temperature, bubbles form within the fluid. When those bubbles contact a surface, such as a metal surface, they implode. The implosion of the bubbles can pit or damage metal surfaces. Thus, cavitation is typically avoided in prior art fluid systems. A main feature of the present invention is the realization that cavitation can be used for beneficial purposes. In particular, a pulsating fluid directed into a vessel at such frequency pressures and temperatures that it cavitates within the vessel, generates heat, heating the fluid. The heat is relatively easy and efficient to generate, and in addition the cavitation of the fluid within the vessel removes any scale or impurities, self-cleaning the vessel.

According to another feature of the present invention, the frequency and pressure of the pulsed fluids is controlled to achieve optimum cavitation within the vessel. A preferred cyclic frequency and pressure is determined experimentally using a model of the heat exchange structure.

In a preferred embodiment of the present invention, a pump delivers pressurized fluid to a cyclically opened and closed control valve upstream of the vessel to create the pulses. A controlled circuit opens and closes the control valve. A cushion is disposed between the pump and the valve to absorb fluid hammers when the valve is closed.

A feedback sensor is preferably disposed between the valve and the vessel, to sense the frequency and intensity of the pressure pulses passed from the valve towards the vessel. This feedback is directed to the controller for the valve, assuring the valve is operating as desired.

The present invention discloses both a method and an apparatus for utilizing pulsating fluid which cavitates within a vessel as a heat exchange system.

Further objects and features of the present invention can be best understood from the following specification and drawings, of which the following is a brief description.

DETAILED DESCRIPTION OF A PREFERRED EMBODIMENT

Figure 1:
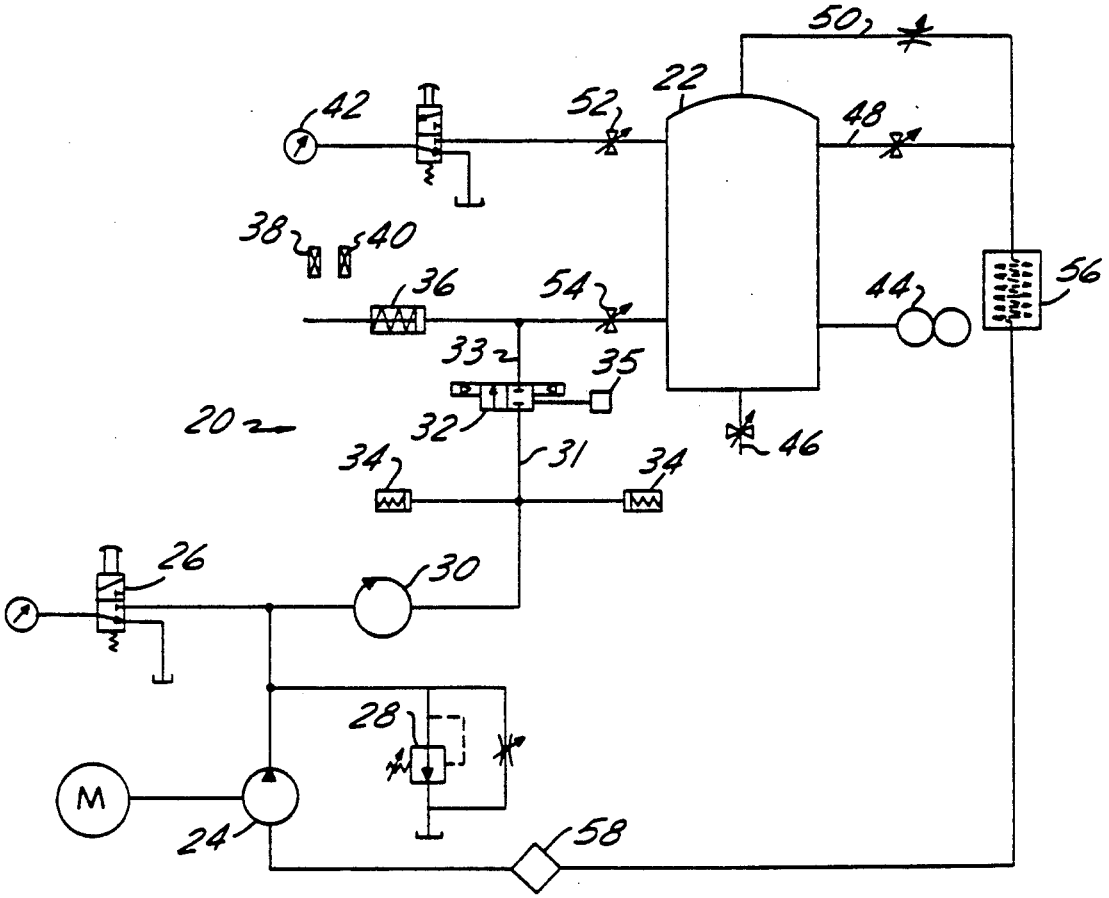
FIG. 1 is a largely schematic view of a fluid system which may be utilized as a heat exchange system.

FIG. 1 is a largely schematic view of a generic fluid system 20 which is modified to perform various functions. Co-pending application Ser. No. 07/698,545 describes system 20 being used to clean vessels. Fluid vessel 22 is disposed within circuit 20, and may be any one of a number of types of fluid vessels. In the present invention, fluid vessel 22 is used to generate heat.

Pump 24 delivers pressurized fluid to downstream locations. Bypass valve 26 and pressure regulator valve 28 are disposed upstream of pump 24. Flow member 30 monitors the amount of fluid flowing from pump 24 into line 31, downstream of flow meter 30. Fluid from line 31 is directed into a cyclically operating control valve 32, which opens and closes to allow fluid pulses to move from line 31 to line 33. A controller 35, shown schematically, operates to open and close valve 32.

When valve 32 is closed, a pressure hammer may be directed back upstream along line 31. "Cellular plastic cushions" 34 absorb these hammers. In one preferred embodiment, cushions 34 consisting of a steel pipe (cylinder) enclosed at one end and filled with rigid plastic, remote from line 31, put opening into line 31. The foam is tightly received within the closed end of the pipe (cylinder) such that the pressure hammer moves into cushion 34 and compresses the foam, which absorbs the hammer.

When valve 32 is open a pressure pulse is directed into line 33. A pressure wave sensor 36 monitors the frequency and intensity of these pulses. Pressure sensor 38 and vacuum sensor 40 monitor the position of a piston, disclosed below, within pressure wave sensor 36 and give an indication to controller 35 for valve 32 of the actual intensity and frequency of the pulses in line 33.

Pulses in line 33 are directed into fluid vessel 22. Fluid vessel 22 is preferably flooded prior to the application of these pulses. Preferably, the intensity frequency and pressure of the fluid pulses directed into vessel 22 are controlled such that the pulses cavitate upon being exposed to the relatively large volume vessel 22. Cavitation may occur when a fluid is exposed to an environment at which it moves to the vapor pressure for its temperature. As an example, a highly pressurized fluid suddenly being exposed to a larger area creates cavitation, if conditions are closely controlled. Further the rapid changes between the high pressure and vacuum as valve 32 opens and closes may cause cavitation. The cavitation of the fluid within vessel 22 generates heat, heating the fluid. That heated fluid is used beneficially under the teachings of this application.

Pressure indicator 42 is disposed on a line communicating with pressure vessel 22. Thermal wall 44 taps heat from the interior of vessel 22, which may be used for beneficial purposes. Thermal well 44 need not be utilized if vessel 22 is used to generate heat for a heat exchange system. Drain line 46 may communicate to fluid vessel 22, and may allow draining of fluid when cleaning vessel 22. Outlet lines 48 and 50 lead from vessel 22. Line 50 may be utilized to vent entrapped gas from vessel 22. Line 48 includes a selectively open valve while line 50 includes a relief valve. A selectively open valve 52 is on the line leading to pressure indicator 42. A selectively open valve 54 is disposed between line 33 and vessel 22. By closing valves 52, 54 and the valve on line 48, one isolates vessel 22 from the remainder of the system 20. This is done when it is desired to disconnect vessel 22 from system 20. Member 56 mounted downstream of outlet line 48 may include a filter or heat exchange structure, as will be explained below. A line from member 56 leads into sump 58 which returns the fluid back to pump 24.

Figure 2:
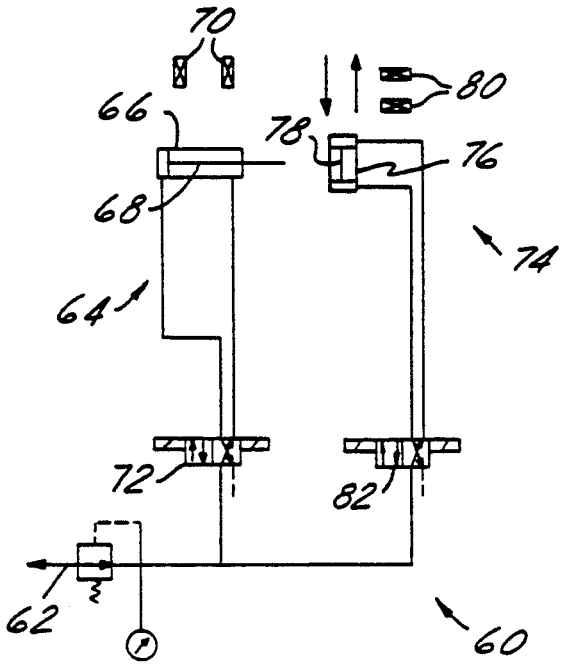
FIG. 2 is a schematic of a hydraulic control for a control valve according to the present invention.

FIG. 2 discloses hydraulic control circuit 60 for valve 32. Line 62 leads from a source of pressurized fluid. Lock circuit portion 64 includes lock cylinder 66 receiving piston 68. Sensors 70 detect the position of piston 68. Valve 72 directs fluid to opposed ends of cylinder 66 to retract or extend piston 68. Piston 68 may lock valve 32 in either an open or closed position. The lock circuit is typically left open during operation of system 20.

Cyclic circuit portion 74 is utilized for the cyclic operation of valve 32. Cylinder 76 receives piston 78 and sensors 80 detect the position of piston 78. Valve 82 directs fluid to the opposed end of piston 78 to move it between open and closed positions, as will be explained below. Controller 35 controls the operation of valve 82.

Figure 3B:
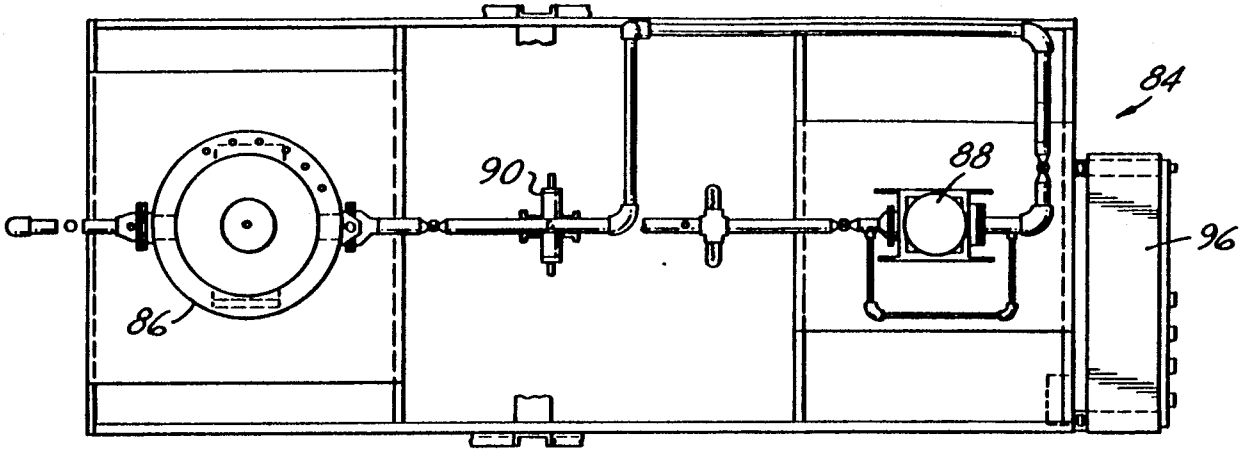
FIG. 3B is a top view of the test rig shown in FIG. 3A.
Figure 3A:
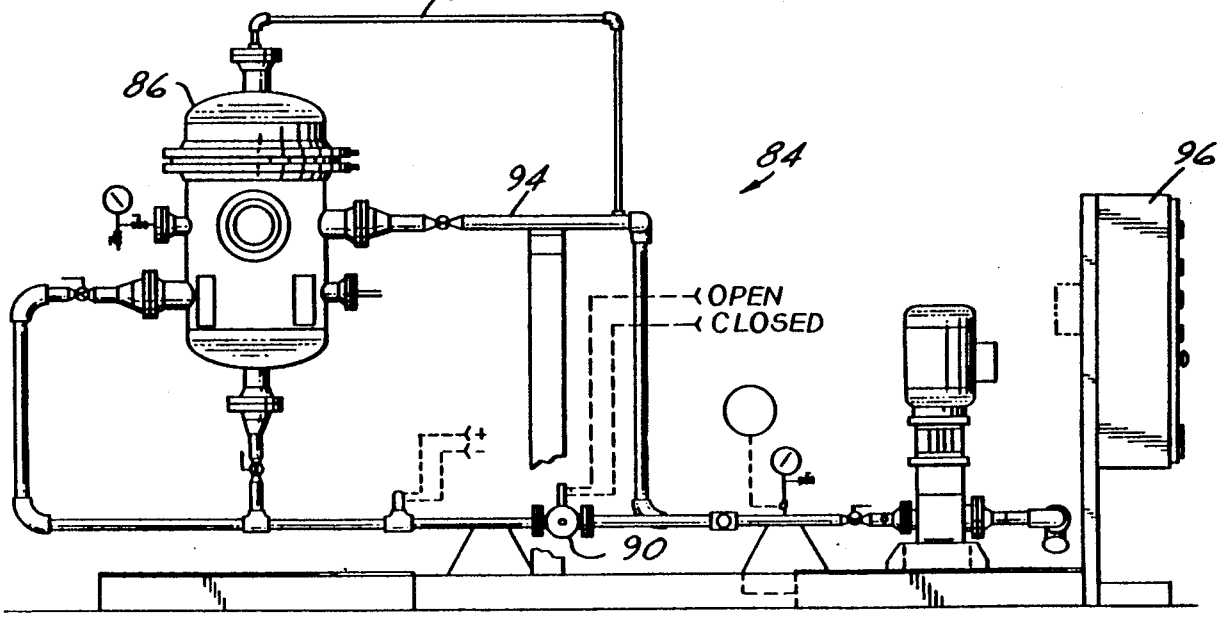
FIG. 3A is a side view of a test rig for developing preferred operating characteristics.

FIG. 3A shows test rig 84 for determining a preferred cyclic frequency and pressures for the fluid pulse flow through valve 32. Rig 84 includes experimental vessel 86 which is modeled to approximate a vessel to be used with system 20. Vessel 86 receives fluid from pump 88. Fluid from pump 88 passes through the cyclical control valve 90 which is connected to a computer control. Outlet lines 92 and 94 return fluid back to a sump for pump 88. Control 96 is used to vary frequency and pressure of the fluid pulses passing into vessel 86 to experimentally determine optimized cyclic frequencies and pressures for the fluid. The frequency and pressure are selected to achieve optimum cavitation and heat generation. The data generated by utilizing experimental test rig 84 may be incorporated into a dedicated controller 35 for an actual circuit 20.

FIG. 3B is a top view of test rig 84. Vessel 86 is mounted downstream of valve 90 which is downstream of pump 88.

Figure 4A:
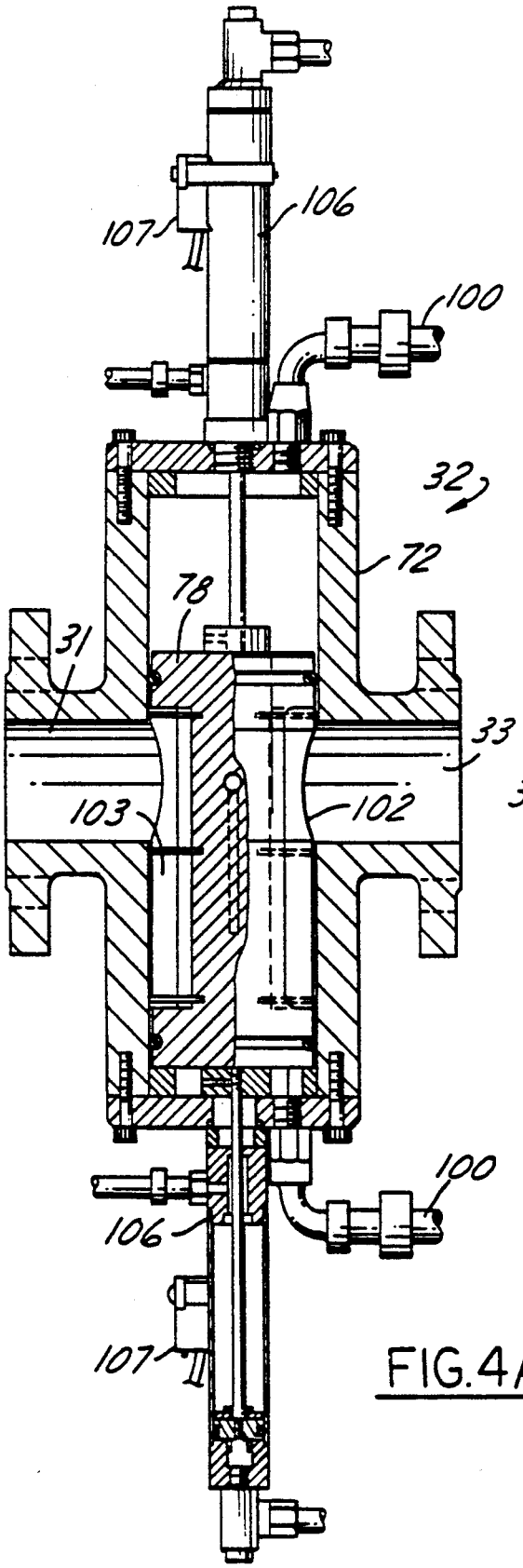
FIG. 4A is a view of a control valve in an open position.

Valve 32 will now be explained with reference to FIGS. 4 and 5. FIG. 4A illustrates valve 32 including cylinder 72 which receives piston 78, which is preferably formed of stainless steel, although other materials may be used. Piston 78 is shown in an open position allowing fluid from line 31 to pass through opening 102 to line 33. Opening 102 is preferably the same diameter as both lines 31 and 33 to eliminate any restrictions on the flow line. Pressurized fluid is directed through lines 100 into pressure chambers on opposed sides of piston 78 to move it between the open position illustrated in FIG. 4A, and a closed position illustrated in FIG. 4B. A teflon sleeve 103 is mounted on piston 78 where it contacts the interior of cylinder 72 to prevent fluid leakage, wear and to facilitate sliding movement of piston 78. Cushions 106 are mounted at locations spaced from the pressure chambers receiving fluid 100, to absorb the shock from rapid movement of piston 78 between open and closed positions. Electromagnetic detents 107 detect the position of a piston within cushion 106.

Figure 4B:
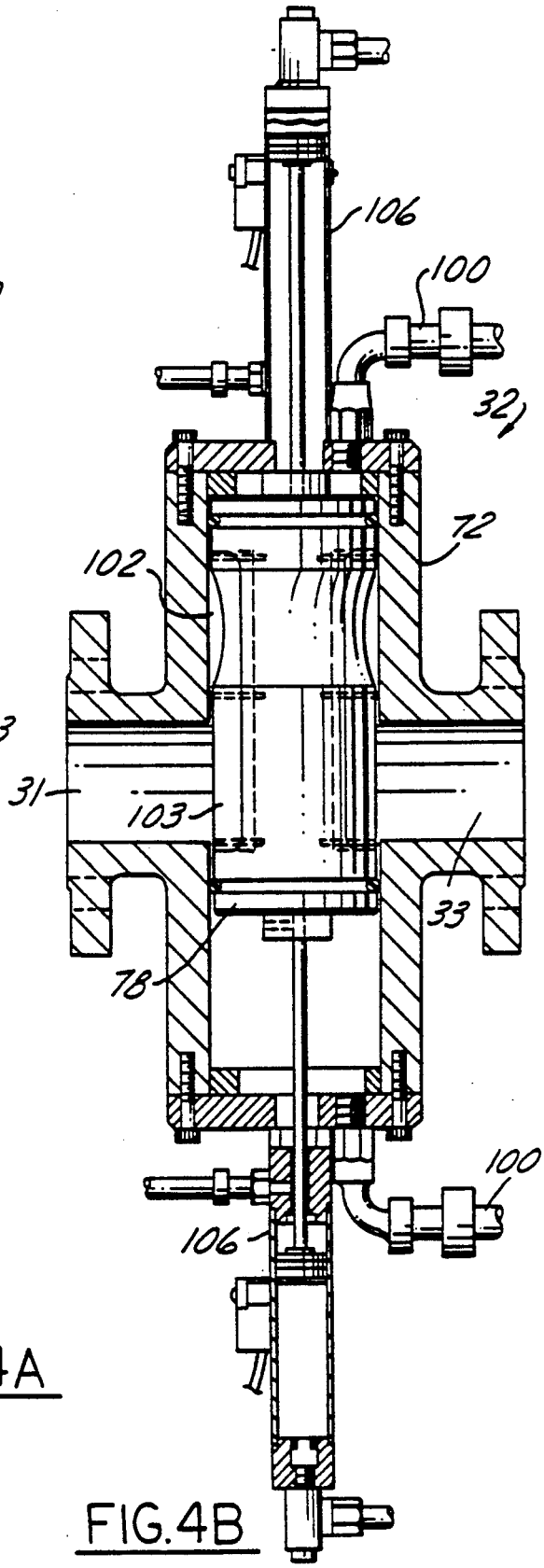
FIG. 4B is a view of the valve shown in FIG. 4A in a closed position.

As shown in FIG. 4B, piston 78 has been moved to the closed position. Shield 103 now blocks fluid flow between line 31 and 33.

Figure 5B:
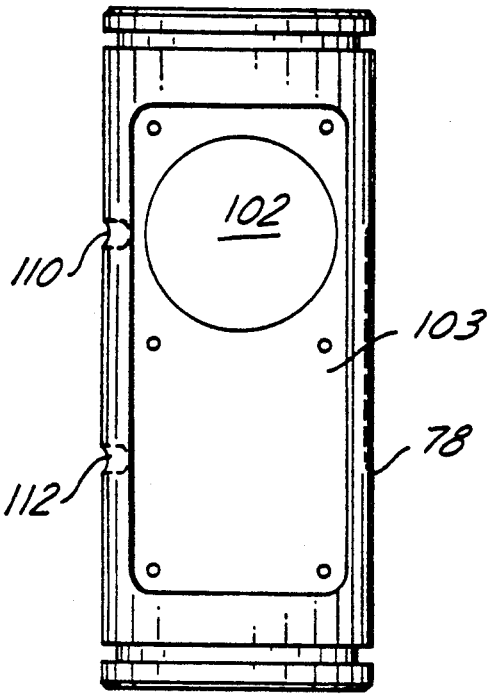
FIG. 5B is a front view of the valve shown in FIG. 5A.
Figure 5A:
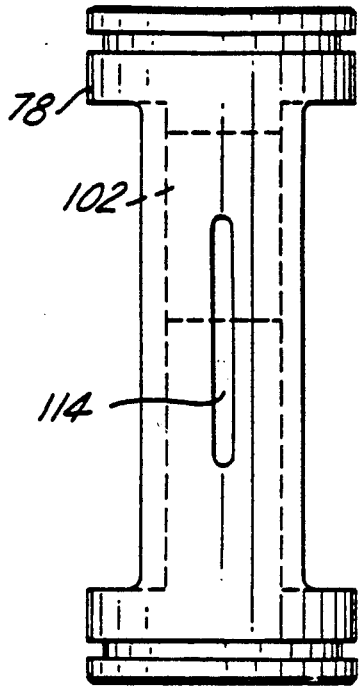
FIG. 5A is a side view of a valve body according to the present invention.

FIG. 5A illustrates the side of piston 78. Line 102 passes through valve 72. Guide slot 114 is formed in the side of valve 78 and receives a spring-biases ball, not shown, mounted within cylinder 72, to ensure that the movement of piston 78 relative to 72 is along an intended direction.

FIG. 5B shows locking holes 110 and 112 at spaced axial locations on piston 78. Line 102 passes directly through piston 78. Teflon shield 103 surrounds the area of fluid lien 102.

Figure 5C:
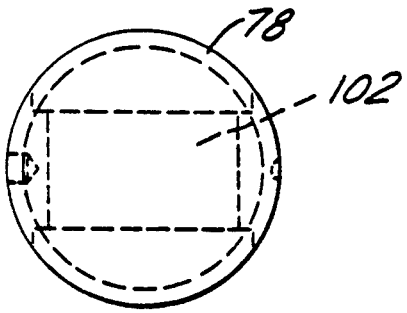
FIG. 5C is an end view of the valve shown in FIG. 5A.

FIG. 5C is a top view of piston 78. Line 102 passes through its entire extent.

Figure 5D:
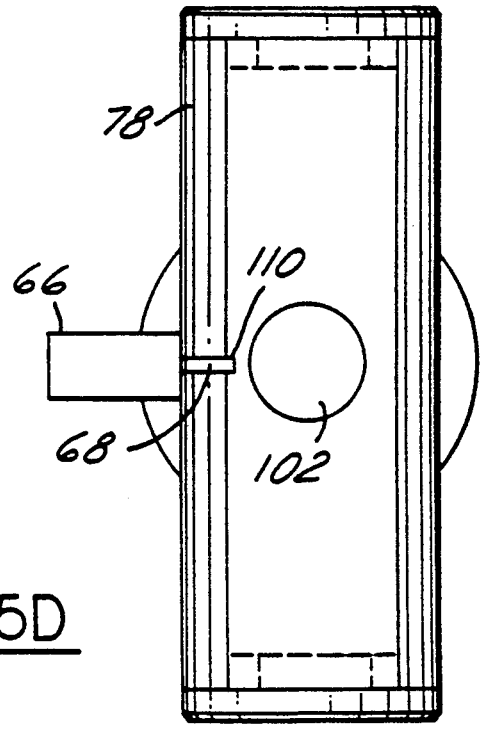
FIG. 5D is a largely schematic view of the valve shown in FIG. 5A, and further illustrates a clocking feature according to the present invention.

FIG. 5D shows locking piston 68 in hole 110. This locks piston 78 at a position where line 102 is open and allows fluid flow between line 31 and 33. During normal cyclic movement of valve 32, piston 78 would not be locked. There may be occasion when it is desired to lock piston 78 at a particular location, however, and cylinder 116 can lock piston 78 at either the opened or closed positions. The controller for valve 32 receives a feedback signal from locking piston 118.

Figure 6:
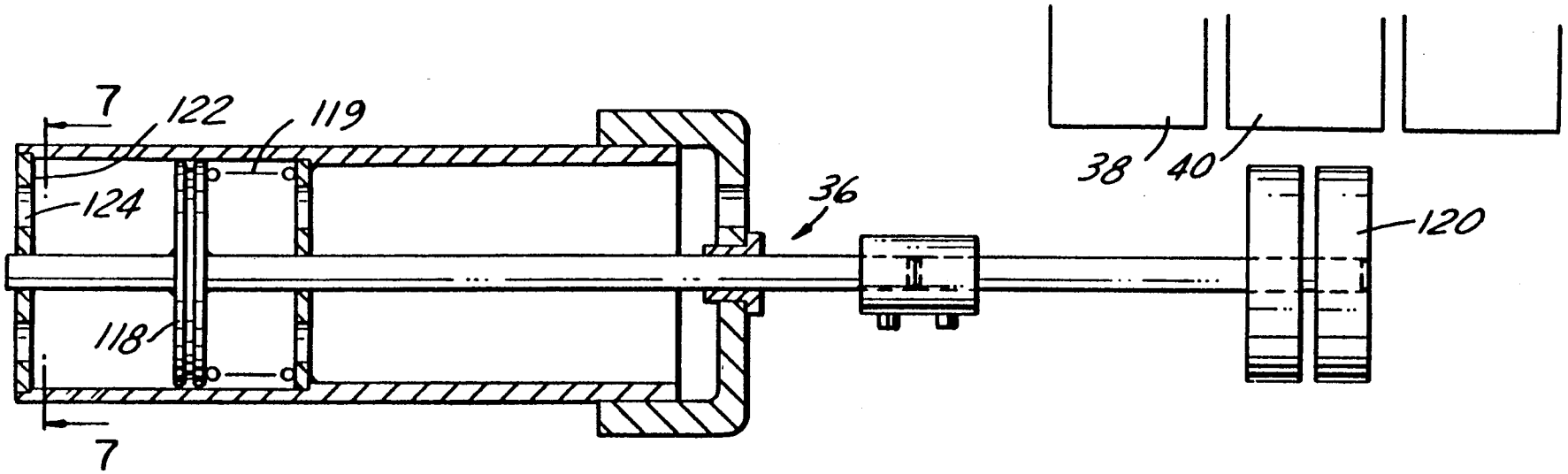
FIG. 6 is a view of a feedback member utilized with the present invention.

FIG. 6 shows details of pressure wave sensor 36. Spring 119 biases piston 118 and piston end 120 away from sensors 38 and 40. Closure member 122 is mounted on an end of pressure wave senor 36 which faces line 33. Openings 124 pass through closure member 122. When valve 32 is closed a vacuum is drawn on line 33, and spring 120 forces piston 120 to the left as shown in this figure. Sensor 38 identifies that a vacuum exists on line 33. When a pressure pulse is directed on line 33, the pulse will force piston 120 to compress prig 118 and move towards the positions illustrated in FIG. 6. Sensor 40 then determines that a pressure pulse is applied on line 33. Sensors 38 and 40 send this information to controller 35 for valve 32.

Figure 7:
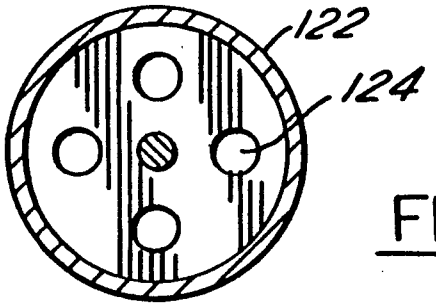
FIG. 7 is a view along line 7—7 as shown in FIG. 6.

FIG. 7 is an end view of closure 122. A plurality of fluid ports 124 pass through closure 122.

Figure 8:
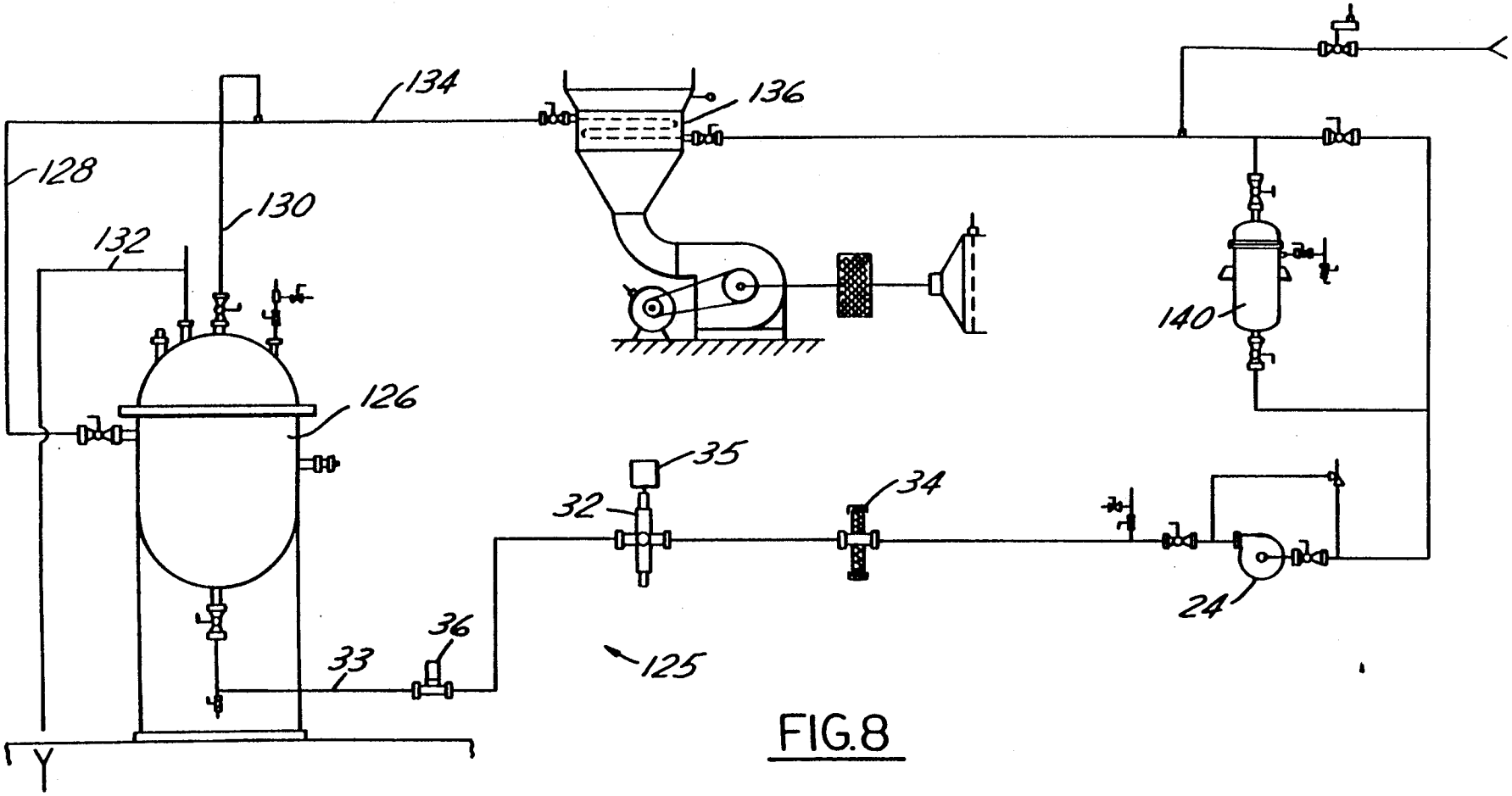
FIG. 8 is a partially schematic view of a heat exchange system according to the present invention.

FIG. 8 is a partially schematic view of a heat exchange system 125 according to the present invention. Pump 24 directs fluid past cushion 34 to valve 32. Pressure wave sensor 36 is disposed on line 33 between valve 32 and vessel 126 where heat is generated. Line 128 leads outwardly of vessel 126 and vent line 130 communicates to line 128. Drain line 132 may be utilized for cleaning vessel 126. Line 134 leads to heat exchange structure 136. Fan 138 directs air to be heated over heat exchange structure 136. Fluid moves from heat exchange structure 136 to sump 140, where it is recycled back to pump 74. Although a particular heat exchange structure is illustrated, it should be understood that others would come within the scope of this invention.

When it is desired to generate heat, vessel 126 is flooded. Fluid is then directed from pump 24, through valve 32 and into vessel 126. The cyclic pulses of fluid moving into vessel 126 cause cavitation within the vessel, and heat is generated in the fluid. That heated fluid is directed into line 134 and heat exchange structure 136. Air from fan 138 is passed over heat exchange structure 136 and is heated. Vessel 126 may include a feedback line leading back to controller 35 for valve 32.

With the inventive system, a relatively small amount of energy is necessary to generate heat within vessel 126. Further, the fluid pulsing into vessel 126 self-cleans vessel 126 during operation. The inventive heat exchange system is relatively efficient to operate and maintain.

The pulsed fluid is preferably water. In a preferred embodiment of the present invention vessel 136 is lined with a styrene-butadiene copolymer, in-situ cured and bonded. This provides a surface in the vessel that is resistant to damage from the cavitating fluid. Cavitating fluid would still clean the tank interior. Valve 32 may take approximately 1 second to open or close. It may preferably remain closed 2 seconds and open 2–3 seconds. These times are approximate and not limiting on this invention. The exact times should be determined experimentally for a particular application. Cylinders 106 and 116 may be a air cylinder manufactured by Bimba Manufacturing Company of Monee, Ill., preferably Model No. MRS-09-DZ is utilized. The approximate pressure for the fluid leading from pump 24 on the order of zero p.s.i. to 1600 p.s.i. and is determined experimentally. Flow volumes are on the order of 3 cubic feet per second.

Although preferred embodiments of the present invention have been disclosed, a worker of ordinary skill in the art would recognize that certain modifications would come within the scope of this invention. For that reason, the following claims should be studied in order to determine the true scope and content of this invention.

I claim:

1. A heat exchange structure comprising:

a source of pressurized fluid, a valve communicating with said source of pressurized fluid, said valve being cyclically operable to open and close a line and allow the source of pressurized fluid to direct fluid through said valve;

a vessel downstream of said valve such that said opening and closing of said valve allows pulses of said pressurized fluid to reach said vessel;

a fluid line leading from said vessel to a downstream location; and a heat exchange structure at said downstream location communicating with said fluid line.

2. A heat exchange structure as disclosed in claim 1, wherein a further line leads from said heat exchange structure to a sump, and said sump leads back to a pump, and wherein said pump is said source of pressurized fluid.

3. A heat exchange structure as recited in claim 1, wherein said source of pressurized fluid is a pump, and a cushion is disposed between said valve and said pump to absorb fluid hammers from said fluid when said valve is closed.

4. A heat exchange structure as recited in claim 3, wherein a wave sensor is disposed between said valve and said vessel, said wave sensor delivering a feedback signal indicative of the state of said valve to a controller for said valve.

5. A heat exchange structure as recited in claim 1, wherein a wave sensor is disposed between said valve and said vessel, said wave sensor giving a feedback signal of the state of said valve to a controller for said valve.

6. A heat exchange structure as recited in claim 1, wherein said valve comprises a single piston with an opening at a central location for opening and closing said fluid line, pressure cylinders disposed at opposed axial ends of said piston, and a controller for directing pressurized fluid to one of said axial ends to move said valve between open and close positions.

7. A heat exchange structure as recited in claim 6, wherein fluid cushions are disposed axially outwardly of said pressure cylinders, said fluid cushions absorbing shock from movement of said valve between open and closed positions.

8. A heat exchange structure as recited in claim 1, wherein a controller for said valve is preprogrammed to include preferred cyclic times and pressures for the fluid passing through said valve.

* * * * *